United States Patent [19]

Kirkland

[11] 3,934,288

[45] Jan. 27, 1976

[54] OBJECT RELEASE DEVICE

[75] Inventor: James L. Kirkland, Panama City, Fla.

[73] Assignee: The United States of America as represented by the Secretary of the Navy, Washington, D.C.

[22] Filed: Nov. 18, 1974

[21] Appl. No.: 524,722

[52] U.S. Cl. ..... 9/8 R; 9/41; 244/137 R

[51] Int. Cl.[2] ..... B63B 51/02

[58] Field of Search ..... 9/8 R, 30, 32, 41, 43, 9/44, 45; 114/210, 235 A; 89/1.5 R, 1.5 A, 1.5 G, 1.5 H; 294/83 R; 214/12, 13, 15 R

[56] References Cited

UNITED STATES PATENTS

| | | | |
|---|---|---|---|
| 641,714 | 1/1900 | May | 9/43 |
| 1,087,858 | 2/1914 | Wickham | 9/41 |
| 1,503,407 | 7/1924 | Wilcke | 89/1.5 R |
| 3,012,810 | 12/1961 | Tenney | 294/83 R |
| 3,133,521 | 5/1964 | Cappel | 114/235 A |
| 3,303,945 | 2/1967 | Hubbard | 9/41 |
| 3,341,244 | 9/1967 | Johnson | 294/83 R |

*Primary Examiner*—Trygve M. Blix
*Assistant Examiner*—Gregory W. O'Connor
*Attorney, Agent, or Firm*—Richard S. Sciascia; Don D. Doty; Harvey A. David

[57] ABSTRACT

A system for timely holding and releasing an object to be deployed in a predetermined environmental medium is disclosed as incorporating a platform, a rotatable drum, and supports for said rotatable drum effectively mounted on said platform. A curved arm is attached to said drum at one extremity thereof, and a latch mechanism is releasably connected to the other extremity thereof. A rope extends around said curved arm, from which the object to be deployed is suspended within a shute, barrel, or slide, the latter of which may or may not be a part of the aforesaid platform.

19 Claims, 3 Drawing Figures

WATERPROOF HOUSING
SWITCH
POWER SUPPLY
SOLENOID
TRIGGER MECHANISM
READOUT (LAMP)
SWITCH
OBJECT URGING MECHANISM
LATCH MECHANISM
ROPE, CABLE, OR CHAIN
CHUTE, BARREL, TUBE, OR SLIDE
PLATFORM (SHIP, AIRCRAFT, LAND CRAFT, SPACE CRAFT, SUBMARINE VEHICLE.)
OBJECT TO BE DEPLOYED
BUOY OR MARKER
DRUM ROTATION URGING MOTOR

OBJECT RELEASE DEVICE

STATEMENT OF GOVERNMENT INTEREST

The invention described herein may be manufactured and used by or for the Government of the United States of America for Governmental purposes without the payment of any royalties thereon or therefor.

FIELD OF THE INVENTION

The present invention, in general, relates to object launching devices and, in particular, is a device for holding and releasing such objects as buoys, markers, and the like, of considerable weight by means of apparatus of much lighter weight and considerable less holding force.

DESCRIPTION OF THE PRIOR ART

Launchers of objects of various sorts and kinds are quite numerous in the art; in fact, they are too numerous to discuss each thereof in a meaningful manner. Therefore, it should suffice to say that there are rocket launchers, torpedo launchers, guns, other buoy and marker launchers, most of which those skilled in the art would be familiar. Unfortunately, however, most of the launchers of the prior art have some disadvantages, the obviation of which would, of course, be desirable for many practical purposes. For example, many of the prior art devices employ explosives to break the bond between the platform or launcher and the object to be launched, some of which are dangerous to handle and use. Moreover, as a matter of fact, in some instances the explosive device supports the entire load of the object to be launched and, thus, must be strong and safe enough to bear such load under conditions of shock and vibration. In addition, some of such devices require the use of elaborate electrical power or mechanical impact pressure for the purpose of effecting the detonation thereof. Of course, after each firing of such explosive launching devices, it becomes necessary to re-load the explosive firing circuits and the explosive components. In many cases, such operations require the opening of seals, breaches, connectors, etc.; and during the launching of buoys and marine markers, so doing leads to difficulty in re-sealing to keep water out, since such launchings occur in aqueous, subaqueous, or extremely humid atmospheric environments.

With respect to mechanical launchers, per se, the apparatus employed is generally large and must be very strong, inasmuch as it must be strong enough to hold the weight of the object to be launched. Furthermore, the release thereof, in many instances, is either complex or dangerous, or both.

Consequently, it may readily be seen in view of the above, that even minor improvements in launchers which advance the state of the art are significant, especially when it is considered how crowded the art is. And, also from the above, it may be discerned that the launcher or releasing device constituting this invention does constitute a significant advancement in the art and, hence, is of both practical and legal significance.

SUMMARY OF THE INVENTION

The subject invention overcomes some of the advantages of the prior art devices, in that, relatively speaking, it is simple in structure, simple and safe to operate, and only requires a small holding force to hold and effect the launching of an object of much larger force or mass.

It is, therefore, an object of this invention to provide an improved object launcher.

Another object of this invention is to provide an improved object releasing mechanism.

Still another object of this invention is to provide an improved method and means for launching and/or releasing a buoy, a marker, or the like, into predetermined aqueous, subaqueous, or atmospheric environmental mediums.

A further object of this invention is to provide an improved method and means for holding and releasing a large mass or force with a smaller mass or force.

Another object of this invention is to provide an improved buoy releasing device that, relatively speaking, is easily and economically constructed, operated, maintained, and transported.

Other objects and many of the attendant advantages will be readily appreciated as the subject invention becomes better understood by reference to the following detailed description, when considered in conjunction with the accompanying drawings.

DESCRIPTION OF THE PREFERRED EMBODIMENT

Figures 1, 2, 3:
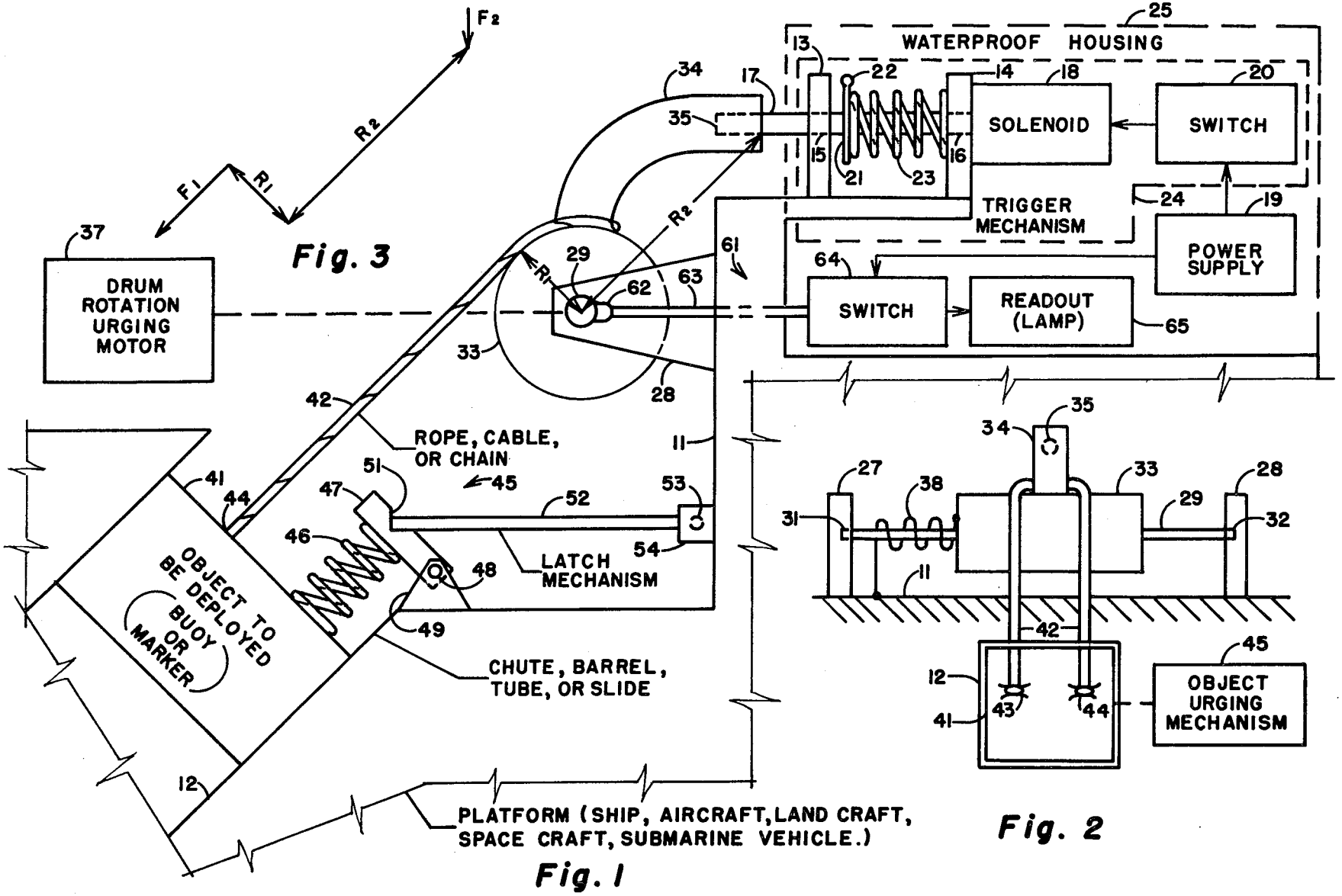
FIG. 1 is a schematic and block diagram elevational view, with parts broken away of the object release and launching device constituting this invention.
FIG. 2 is a left-ended schematic view of a portion of the device of FIG. 1, primarily showing the drum and its rotational release and rotational urging assembly.
FIG. 3 illustrates a representative force diagram of the various forces operating within the invention prior to the release of the object being held.

Referring now to FIG. 1, there is shown a platform 11 which may have any configuration necessary to hold the remainder of the apparatus of the invention thereon. It may, of course, be fixed in position — as it would be if it were land — or it may be mobile — as it could be if it were a ship, an aircraft, a land craft, a submarine craft, or any other movable or moving vehicle.

In this particular preferred embodiment, a chute 12 is disclosed as being integrally connected to platform 11; however, it should be understood that it may, if so desired, be separate therefrom without violating the spirit or scope of the claimed invention. Moreover, although chute 12 is shown, in this particular instance, as being slanted downwardly at an angle, it may be made vertical in a downward or upward direction, or it may be designed to have any other desired angle relative to platform 12 that operational circumstances warrant. Hence, it may even be at an upward angle or a downward angle if trajectory requirements necessitate such attitudes.

Mounted on platform 11 is a pair of supports 13 and 14 with aligned bearing holes 15 and 16 respectively located therein. Extending through and protruding from bearing holes 15 and 16 is a locking shaft 17, one end of which is connected to the movable armature of a solenoid actuator 18. An electrical power supply 19 is connected through an electrical switch 20 to the electrically energizable field of solenoid 18. In this particular case, solenoid 18 should be so designed as to pull shaft 17 in the right hand direction (as shown in FIG. 1) whenever it becomes energized as a result of the closure of switch 20.

Through a hole 21 extending through shaft 17 is a cotter pin 22, and between cotter pin 22 and the left hand surface of support 13, is a spring disposed in a compressed state around shaft 17, so as to effectively cause said shaft 17 to be constantly urged in a left hand direction, in opposition with the pull of solenoid 18 whenever it is electrically energized.

From the foregoing, it may readily be seen that elements 13 through 23 constitute a trigger mechanism 24. It may optionally be housed in a waterproof housing 25, in the event operational circumstances make it expedient to do so.

Also mounted on platform 11 is another pair of supports 27 and 28, of which only support 28 can be seen in FIG. 1, while both thereof are depicted in FIG. 2. A shaft 29 is mounted in bearing holes 31 and 32 located in said supports 27 and 28, respectively, and a drum 33 is mounted for rotation with said shaft 29. Integrally or otherwise conventionally connected (as by welding, bolting, or the like) to drum 33 is an arm 34 which preferably has an arcuate curve along the length thereof, as shown in FIG. 1 (but may have any other suitable configuration), and in the outer extremity thereof is a hole 35, the size of which is such at that the left end of shaft 17 may be compatibly inserted therein.

As is shown in FIG. 1, any suitable drum rotation urging motive force or motor 37 may be connected to drum 33 and/or shaft 29, so as to effect the rotational urging thereof in a counter-clockwise manner at all times. Although the artisan having the benefit of the teachings presented herewith would be able to select an appropriate motor for such arrangement, as best seen in FIG. 2, it may be as simple as a "wound" spring 38 effectively connected between platform 11 and drum 33.

The object to be released or otherwise deployed is shown as being object 41 which is depicted as being disposed in chute 12 and, thus, ready for release or deployment.

It would ostensively be apparent that object 41 may be anything that is capable of being loaded in chute 12, and that it may be loaded therein from either end thereof. Hence, without limitation, and by way of example only, object 41 may be a buoy, marine or other marker, or other device having mass. Although, as shown, chute 12 has an angular attitude with respect to the vertical, it may, in fact, be so constructed as to have any desired attitude, and, of course, it may be a structure that is separate and distinct from platform 11, if so desired. Moreover, it may be constructed in such manner that object 41 is shot, urged, or deployed in an upward direction with any desired trajectory path. Nevertheless, in order to keep this disclosure as simple as possible, the representative downward-and-to-the-left attitude has been given to chute 12.

Connected to object 41 in any conventional manner is a rope, cable, or chain 42, the other end of which is wrapped or looped around the aforesaid arm 34 and around drum 33 as necessary to be wrapped around said arm 34. The particular rope connection and wrapping arrangement can best be seen in FIG. 2, with the ends of rope 42 connected by connectors 43 and 44 to object 41.

There may be times when it would be preferable for object 41 to be initially assisted down or out of chute 12 after its release. Thus, any object urging mechanism 45 may be employed for such purpose.

As seen in FIG. 1, such urging mechanism may take the specific form of a spring 46 that is compressed against object 41 by means of a backing plate 47 that pivots on shaft 48 which, in turn, is connected to supports 49 that are mounted on platform 12. A notch 51 in plate 47, allows a rod 52 to be disposed therein for position securing purposes. To facilitate the loading of object 41 from the top, rod 52 is rotatable about a shaft 53 that is secured to supports 54 which are, in turn, connected to platform 11.

The aforementioned object urging mechanism 45 is shown by way of example only; consequently, any other suitable type may be employed as warranted by operational circumstances. For instance, it may be of the type that incorporates an explosive charge that is triggered and detonated at the time object 41 is released, or it may be pneumatically operated, thereby shooting object 41 out of chute 12. Moveover, urging mechanism 45 should be considered as being optional, in that, in some instances, it may not be necessary or desirable at all.

FIG. 2 illustrates in block form a generalized version of object urging mechanism 45, in order to emphasize the fact that any appropriate object urging means may be optionally included in the invention.

Optionally, an actuation indicator circuit 61 may be incorporated in the invention which includes a cam 62 connected to shaft 29 for rotation therewith, and a cam-follower 63 that actuates a switch 64 connected between the aforesaid power supply 19 and any suitable readout, such, for example, as a lamp 65.

MODE OF OPERATION

The operation of the invention will now be discussed briefly in conjunction with all of the figures of the drawing.

From the views depicted in FIGS. 1 and 2, it may readily be seen that the structure of the invention is exceedingly simple, but that the invention performs an exceedingly important function, though it, likewise, is quite simple.

FIG. 1 obviously shows object 41 loaded in shute 12 (and ready to be deployed) and arm 34 and drum 33 held in position by sliding shaft 17 being inserted in end hole 35. In such position, drum 33 cannot rotate and, thus, rope 42 remains securely held adjacent to the surface of said drum 33 by arcuate arm 34. Obviously, as long as rope 42 is securely held in such manner, object 41 will likewise be held in place.

When it is desired to release object 41, switch 20 is manually or otherwise closed, thereby causing power supply 19 to electrically energize solenoid 18 which, in turn, withdraws shaft 17 from hole 35 of arm 34 against the bias of spring 23. Once shaft 17 has been so withdrawn, drum 33 and arm 34 are immediately rotated due to the tension in rope 42. Of course, once said drum 33 and arm 34 have rotated about one-half turn or so, rope 42 slides off the end of arm 34 and, in this case, drops objects 41 through chute 12.

At this time, it would appear to be noteworthy that cotter pin and spring 23 are incorporated in the invention as a safety feature, since they combine to urge shaft in a latched position in the hole of arm 34 until such time as solenoid 18 is energized.

As a general rule, no urging of object 41 is needed to eject it from a vertical shute 12, since it tends to fall of its own weight after it is released. Nevertheless, there may be some instances when some additional assistance is needed — such as, for example, when shute 12 has sufficient angular slant to cause excessive friction between object 41 and shute 12 — to start object 41 moving down the shute. With the proper design of rope 42 and spring 46, once cocked by shaft 17, object 41 rests against the compression bias of spring 47. Obviously, release of arm 34 effectively frees object 41, so that the release of the decompression force of spring 46 will cause it to be shoved down chute 12, thereby facilitating the proper ejection thereof.

In addition, if so desired, a tightened torison spring 38 (FIG. 2) or any suitable motor 37 (FIG. 1) may be used to timely and rapidly effect the rotation of drum 33 in the counterclockwise direction as soon as arm 34 is released.

As previously suggested, other conventional methods and means — such as explosive charges or air jets — may be combined with the remaining structure of the invention to timely assist object 41 on its way down and out chute 12, and they may be quite helpful in the event chute 12 is tilted in such manner that either the friction therebetween is too great or the mass of object 41 operates in the wrong direction to allow it to be self-propelled in the right direction. Obviously, it would be well within the purview of one skilled in the art having the benefit of the teachings presented herewith to make all of the aforesaid design changes necessary to optimize the subject invention during any given operational circumstances.

Referring now to the force diagram of FIG. 3, it may be seen that the following relationship holds true:

$$F_1R_1 = F_2R_2, \quad (1)$$

where $F_1$ is a large force, such as that provided by object 41, $R_1$ is the radius of drum 33, $F_2$ is a very small force, such as that applied to shaft 17 by arm 34 during a latched condition, $R_2$ is the distance to the center of the end of arm 34.

In the latched condition, the equilibrium of equation (1) exists, and, thus, it may readily be seen that very small force $F_2$ is all that is needed to hold very large force $F_1$ (relatively speaking), a very important feature of the invention, indeed.

Although not shown in the drawing, all function surfaces may have suitable bearings substituted therefor by the artisan, if so desired. For example, the friction necessary to be overcome by the solenoid may be minimized by using low-friction bearings in the construction of locking arm 34, shaft 17, supports 13 and 14, and the like.

From the foregoing, it should be obvious that an exceedingly useful method and means for holding a large mass or force with a small mass or force has been effected; and because of its simple but unique function and construction, the invention does, indeed, constitute an important advancement in the art.

As is probably obvious, cam 62, cam-follower 63, switch 64, and lamp 65 cooperate to indicate when shaft 29 has been rotated and, thus, indicate whether or not object 41 has been launched, regardless of whether it is day or night.

Obviously, other embodiments and modifications of the subject invention will readily come to the mind of one skilled in the art having the benefit of the teachings presented in the foregoing description and the drawings. It is, therefore, to be understood that this invention is not to be limited thereto and that said modifications and embodiments are intended to be included within the scope of the appended claims.

What is claimed is:

1. A system for holding and timely releasing an object to be deployed in a predetermined environmental medium, comprising in combination:

platform means;

a rotatable drum means;

arm means connected to said rotatable drum means for rotation therewith;

means connected between said platform means and said rotatable drum means for supporting said drum means in such manner as to allow relative rotation therebetween;

cable means extending around said arm means and around a portion of the periphery of said drum means;

an object, intended to be deployed in said predetermined environmental medium, connected to the end of said cable means that is opposite the end thereof that extends around the aforesaid arm means;

a hole located in the end of the aforesaid arm means;

a shaft, with one end thereof slidably movable in and out of the hole of said arm means;

means effectively connected to the aforesaid platform means for slidably supporting said shaft with respect thereto;

a cotter pin extending through said shaft; and a compressible spring disposed around said shaft between said cotter pin and the aforesaid shaft supporting means in such manner as to urge said shaft in such direction as to cause it to be timely inserted in the hole in the end of said arm means until moved out thereof in response to a predetermined signal.

2. The system of claim 1, wherein said object intended to be deployed is a buoy.

3. The system of claim 1, wherein said object intended to be deployed is a marker.

4. The system of claim 1, wherein said means connected between said platform means and said rotatable drum means for supporting said drum means in such manner as to allow relative rotation therebetween comprises:

a pair of spatially disposed supports, having a pair of aligned bearing holes therein, respectively, connected to the aforesaid platform means; and a shaft, mounted between and for rotation within the bearing holes of said pair of spatially disposed supports, connected to said rotatable drum means for rotation therewith.

5. The system of claim 1, wherein said arm means connected to said rotatable drum means is arcuate in geometrical configuration and has a hole in the end thereof that is opposite to the end thereof that is connected to said rotatable drum means.

6. The system of claim 1, wherein said platform means is one which is fixed relative to the earth.

7. The system of claim 1, wherein said platform means is one which is mobile relative to the earth.

8. The system of claim 1, wherein said platform means is a marine vehicle.

9. The system of claim 1, wherein said platform means is a ship.

10. The system of claim 1, wherein said platform means is an aircraft.

11. The system of claim 1, wherein said platform means is a space craft.

12. The system of claim 1, further characterized by means connected to said rotatable drum means for urging the rotation thereof upon release of said arm means by said arm holding and releasing means.

13. The system of claim 1, further characterized by means effectively connected to said rotatable drum means for indicating the rotation thereof and, thus, the deployment of the aforesaid object within said predetermined environmental medium, regardless of whether said deployment takes place day or night.

14. The system of claim 1, further characterized by means in abutment with said object to be deployed and connected to said platform means for effecting the urging of said object toward a deployed condition upon release of the aforesaid arm means by said arm holding and releasing means.

15. The system of claim 1, further characterized by:

a solenoid connected to the other end of said shaft for effecting the movement thereof in and out of the hole in the end of said arm means in response to timely electrical de-energization and energization thereof, respectively; and means connected to said solenoid for timely supplying electrical energy thereto, so as to timely effect de-energization and energization thereof.

16. The system of claim 1, further characterized by means relatively slidably disposed around a portion of said object for effecting the guidance thereof along a predetermined course when deployed.

17. The system of claim 16, wherein said means relatively slidably disposed around a portion of said object for effecting the guidance thereof along a predetermined course when deployed comprises a chute.

18. The system of claim 16, wherein said means relatively slidably disposed around a portion of said object for effecting the guidance thereof along a predetermined course when deployed comprises a tube.

19. The system of claim 17, wherein said means relatively slidably disposed around a portion of said object for effecting the guidance thereof along a predetermined course when deployed comprises a slide surface.

* * * * *